US012075929B2

(12) United States Patent
Rosilier

(10) Patent No.: US 12,075,929 B2
(45) Date of Patent: Sep. 3, 2024

(54) PHONE CASE WALL DISPLAY AND ORGANIZER

(71) Applicant: ABBYROSE, LLC, San Antonio, TX (US)

(72) Inventor: Zach Rosilier, Boulder, CO (US)

(73) Assignee: ABBYROSE, LLC, San Antonio, TX (US)

( * ) Notice: Subject to any disclaimer, the term of this patent is extended or adjusted under 35 U.S.C. 154(b) by 0 days.

(21) Appl. No.: 18/146,710

(22) Filed: Dec. 27, 2022

(65) Prior Publication Data

US 2023/0139982 A1 May 4, 2023

Related U.S. Application Data

(63) Continuation-in-part of application No. 17/191,219, filed on Mar. 3, 2021, now Pat. No. 11,564,508.

(51) Int. Cl.

| | |
|---|---|
| ***A47F 7/28*** | (2006.01) |
| ***A47B 96/06*** | (2006.01) |
| ***A47F 5/00*** | (2006.01) |
| ***A47F 5/08*** | (2006.01) |

(52) U.S. Cl.

CPC ..... *A47F 7/285* (2013.01); *A47B 96/068* (2013.01); *A47F 5/0006* (2013.01); *A47F 5/0815* (2013.01); *A47F 5/0876* (2013.01)

(58) Field of Classification Search

CPC ..... A47F 7/285; A47F 5/0018; A47F 5/0006; A47F 5/0815; A47F 5/0876; A47F 7/0042; A47F 7/0246; A47F 7/03; A47F 7/143; A47F 5/0884; A47B 96/067; A47B 96/068; A47B 95/008

USPC ..... 211/106.01, 13.1, 85.9, 118; 248/304, 248/301, 690, 692, 489, 490

See application file for complete search history.

(56) References Cited

U.S. PATENT DOCUMENTS

| | | | | | |
|---|---|---|---|---|---|
| 49,779 | A | * | 9/1865 | Montignani | A47F 5/103 211/106.01 |
| 791,912 | A | * | 6/1905 | Jackson | B65D 73/0064 206/483 |
| 805,378 | A | * | 11/1905 | Newman | G09F 3/00 211/10 |
| 1,726,537 | A | * | 9/1929 | Carmichael | A47F 7/143 40/657 |
| 1,731,408 | A | * | 10/1929 | Finnessy | A47G 25/0607 248/304 |

(Continued)

*Primary Examiner* — Jennifer E. Novosad

(74) *Attorney, Agent, or Firm* — INNOVATION CAPITAL LAW GROUP, LLP; Vic Lin

(57) ABSTRACT

A phone case display and organizer can display multiple mobile phone cases so a user can see the design on the back of the cases. The display case and organizer provide a solution for the clutter of multiple phone cases in a decorative and organized way such that the design is visible, and the individual cases are easily accessible for the customer to choose from and use. Typically, phone cases can get damaged when stacked or crowded into small spaces. The display and organizer provide ample room to display the cases in a way that does not damage them while allowing the consumer to see the entire collection side by side in order to use them as fashion accessories. Having the cases displayed out in the open rather that stacked in a drawer allows the consumer to enjoy their collection and remember to use them regularly.

19 Claims, 14 Drawing Sheets

(56) References Cited

U.S. PATENT DOCUMENTS 1,848,937 A * 3/1932 Coventry ..... A47G 25/0678 248/223.41
1,856,847 A * 5/1932 Gates ..... A47G 29/083 211/106.01
2,347,035 A * 4/1944 Douglas ..... A47G 29/10 40/657
2,436,533 A * 2/1948 Thompson ..... A47G 25/08 248/301
2,565,440 A * 8/1951 Soref ..... A47F 5/0876 211/96
2,606,734 A * 8/1952 Magnuson ..... A47G 25/0678 248/301
2,679,998 A * 6/1954 Keller ..... F16B 47/003 D8/367
2,805,777 A * 9/1957 Larson ..... B25H 3/04 211/106.01
2,954,874 A * 10/1960 Rouse ..... A47G 29/10 248/220.31
2,985,315 A * 5/1961 Paruolo ..... A47F 5/0876 211/106.01
3,191,777 A * 6/1965 Willits, Jr. ..... A47F 5/0815 211/106.01
3,442,396 A * 5/1969 Cass ..... A47F 5/0876 248/220.21
3,536,286 A * 10/1970 Kramer ..... A47G 25/06 211/106.01
4,084,700 A * 4/1978 Dunchock ..... A47F 7/021 248/902
4,088,292 A * 5/1978 Emminger ..... A47G 25/0607 403/4
4,326,761 A * 4/1982 Schwartz ..... A47G 29/10 206/580
4,494,661 A * 1/1985 Krusche ..... A47F 5/083 248/220.31
4,573,590 A * 3/1986 Ellis ..... A47F 5/0068 211/85.15
4,711,419 A * 12/1987 Polosky ..... B42D 17/00 281/43
4,771,897 A * 9/1988 Ho ..... A47G 29/10 211/94.01
4,893,777 A * 1/1990 Gassaway ..... E05B 73/0082 211/8
4,938,368 A * 7/1990 Sharman ..... A47F 5/0876 211/85.15
4,986,426 A * 1/1991 Niklaus ..... A47F 5/11 248/116
5,191,972 A * 3/1993 Helzer ..... A47G 1/12 206/0.8
5,341,941 A * 8/1994 Marlor ..... F16M 11/041 211/26.1
5,785,190 A * 7/1998 Otema ..... A47F 5/0823 248/221.12
5,806,692 A * 9/1998 Pepper ..... A47B 96/027 211/70.1
5,836,055 A * 11/1998 Cooper ..... A45D 40/00 24/339
5,911,762 A * 6/1999 Ott ..... G08B 13/1445 211/26.1
5,957,421 A * 9/1999 Barbour ..... A45F 5/02 248/314
5,967,341 A * 10/1999 Werner ..... A47F 5/0884 211/85.15
6,209,734 B1 * 4/2001 Wang ..... D06F 95/004 211/85.15
6,213,316 B1 * 4/2001 Gretz ..... A47F 5/0884 211/85.15
6,283,278 B1 * 9/2001 Holztrager ..... G09F 7/10 206/495
6,312,067 B1 * 11/2001 Blanchard ..... A01M 31/00 40/657
6,453,518 B1 * 9/2002 Adams ..... B42F 15/066 24/67.9
6,585,204 B1 * 7/2003 Haertzen ..... E06C 7/14 248/211
6,643,900 B2 * 11/2003 Jahrling ..... A47B 88/43 24/339
6,763,779 B1 * 7/2004 Borders ..... G09B 1/00 211/26.1
6,971,527 B2 * 12/2005 Chandaria ..... B65D 75/14 211/13.1
7,000,810 B1 * 2/2006 Farmer ..... B60R 11/06 224/543
7,008,029 B1 * 3/2006 Aclin ..... A47B 67/02 312/227
7,270,309 B2 * 9/2007 Burns ..... F16M 13/02 248/220.21
7,789,365 B2 * 9/2010 Durig ..... F16B 2/02 248/300
7,823,853 B2 * 11/2010 Larson ..... F16B 45/00 52/27
8,065,828 B2 * 11/2011 Bevers ..... G09F 3/203 40/657
8,251,342 B1 * 8/2012 Weiner ..... A63C 17/0006 248/692
8,302,769 B2 * 11/2012 Justiss ..... A45F 5/02 206/320
8,360,373 B2 * 1/2013 Johnson ..... H05K 7/026 340/568.1
8,448,793 B2 * 5/2013 Barron ..... A47G 29/00 220/507
8,469,204 B1 * 6/2013 Bradshaw ..... F16M 13/00 211/26.1
8,636,183 B1 * 1/2014 Steiner ..... A45C 11/00 224/560
8,684,195 B1 * 4/2014 Caruso ..... A47B 95/008 211/94.01
8,706,176 B1 * 4/2014 Jia ..... H04M 1/04 455/575.8
8,931,746 B2 * 1/2015 Fanning, Jr. ..... G09F 5/042 248/220.21
9,241,584 B1 * 1/2016 McHatet ..... A47F 3/14
9,681,718 B1 * 6/2017 Poole ..... F16M 11/041
9,732,784 B2 * 8/2017 Clouser ..... F16B 47/003
9,876,885 B1 * 1/2018 Velasquez ..... H04B 1/3877
9,924,809 B2 * 3/2018 Forrest ..... A47G 1/16
10,059,497 B2 * 8/2018 Rehberg ..... B65D 73/0064
10,075,010 B2 * 9/2018 Rosengren ..... H02J 7/0044
10,405,676 B1 * 9/2019 Underwood ..... A47F 5/0846
11,564,508 B2 * 1/2023 Rosilier ..... A47F 7/0042
D991,718 S * 7/2023 Rosilier ..... D6/682.6
2002/0130055 A1 * 9/2002 Morrison, Jr. ..... B65D 85/18 206/297
2002/0145365 A1 * 10/2002 Johnson ..... A47F 3/005 312/114
2003/0025053 A1 * 2/2003 McKeon ..... A47B 96/06 248/304
2004/0031901 A1 * 2/2004 Lin ..... B65D 73/00 248/489
2004/0262248 A1 * 12/2004 Howard ..... A47G 29/10 40/657
2005/0040741 A1 * 2/2005 Simmons ..... A47F 3/005 312/245
2005/0098510 A1 * 5/2005 Lom ..... A47F 7/147 211/13.1
2006/0038097 A1 * 2/2006 Diller ..... A61G 13/101 248/225.11
2008/0200221 A1 * 8/2008 Lockwood ..... A47G 29/10 455/575.1
2009/0229089 A1 * 9/2009 Galant ..... A47F 5/16 24/714.8
2010/0037501 A1 * 2/2010 Danielson ..... G09F 21/02 40/625
2010/0084530 A1 * 4/2010 Lai ..... A47G 25/0678 248/304
2010/0229442 A1 * 9/2010 Snow ..... A47G 1/065 40/761
2011/0155875 A1 * 6/2011 Hofman ..... A47G 25/06 248/220.31

(56) References Cited

U.S. PATENT DOCUMENTS

2012/0012726 A1* 1/2012 Daniels ..... A47G 25/0678 248/304
2012/0047972 A1* 3/2012 Grant ..... E05B 47/06 70/77
2013/0170823 A1* 7/2013 McDonald ..... H04M 1/04 396/428
2013/0292281 A1* 11/2013 Chung ..... H04B 1/3888 206/320
2013/0341412 A1* 12/2013 Johnson ..... G06K 19/06028 235/487
2014/0008405 A1* 1/2014 Beaver ..... B60R 11/0241 224/276
2014/0125454 A1* 5/2014 De Maria ..... A47G 29/10 340/5.73
2014/0190221 A1* 7/2014 Jiang ..... A47G 29/10 206/525
2014/0228082 A1* 8/2014 Morrow ..... H04B 1/3888 455/575.8
2015/0196151 A1* 7/2015 Phipps ..... A47G 29/08 211/85.2
2015/0288409 A1* 10/2015 Forsythe ..... H04B 1/385 455/575.6
2015/0374088 A1* 12/2015 Kim ..... A45C 11/00 224/576
2016/0106214 A1* 4/2016 Hagen ..... H05K 5/0221 248/220.22
2016/0150861 A1* 6/2016 Yao ..... H04B 1/3888 224/245
2016/0174746 A1* 6/2016 Doyle ..... A47G 29/10 211/183
2016/0183392 A1* 6/2016 Kelley ..... H04B 1/3877 211/26
2016/0344437 A1* 11/2016 Gordon ..... H04M 1/05
2017/0308210 A1* 10/2017 Brugger ..... G06F 3/0412
2018/0325228 A1* 11/2018 Leimer ..... A45C 13/1092
2020/0154839 A1* 5/2020 Brown ..... B29C 45/14
2020/0268177 A1* 8/2020 Pääkkö ..... B25H 5/00
2020/0351396 A1* 11/2020 Poon ..... H04B 1/3888
2020/0395769 A1* 12/2020 Glazebrook ..... H02J 50/10
2021/0106106 A1* 4/2021 Reyes ..... F16M 13/022
2021/0384937 A1* 12/2021 Sharma ..... A45C 11/04
2023/0139982 A1* 5/2023 Rosilier ..... A47F 7/022 211/85.26

* cited by examiner

PHONE CASE WALL DISPLAY AND ORGANIZER

CROSS-REFERENCE TO RELATED APPLICATIONS

This application is a continuation-in-part of U.S. patent application Ser. No. 17/191,219, filed Mar. 3, 2021, the contents of which are herein incorporated by reference.

BACKGROUND OF THE INVENTION

1. Field of the Invention

Embodiments of the invention relate generally to mobile electronic device accessories. More particularly, embodiments of the invention relate to a wall display and organizer for cases for electronic devices, such as mobile phones, tablets and the like.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Cell phone cases have made the transition from a tech accessory to a fashion accessory, with many people accumulating a collection of phone cases that they switch between regularly, rather than just having one or two. This has created the need for a way to keep cases protected, organized and accessible so that a person can easily pick from their collection to choose which phone case they want to use/wear on a given day.

The only consumer solution for phone cases is to put them a drawer, basket or storage bin. One problem with this solution is that the cases can become deformed or damaged by being stacked or squished in small spaces or crowded together. This solution is also lacking because it does not allow the person to see the various designs next to each other in order to accessorize an outfit. Finally, putting the cases away in a drawer or basket tends to make the user forget about what they have and not use them. Displaying cases in a way that encourages use creates more consumer satisfaction. The only other solutions for displaying multiple phone cases are in the retail space, with the phone case typically in a box and hanging from a hook. This approach, however, does not transfer to the consumer environment.

SUMMARY OF THE INVENTION

Embodiments of the present invention provide a method for displaying and organizing a plurality of phone cases comprising disposing a plurality of hooks on a back member; and hanging each of the plurality of phone cases on respective ones of the plurality of hooks so that a back side of each of the plurality of phone cases are visible, wherein the plurality of hooks extends from the back member with an upward bend proximate the back member, followed by a distal downward bend to form a front surface; and the plurality of hooks attaches to the back member along a back surface of each of the plurality of hooks.

Embodiments of the present invention further provide a method for displaying and organizing a plurality of phone cases comprising disposing a plurality of hooks on a back member surrounded by a frame; hanging each of the plurality of phone cases on respective ones of the plurality of hooks so that a back side of each of the plurality of phone cases are visible; and positioning a lip of each of the plurality of phone cases into a depression formed along a length of the plurality of hooks extending from the back member, wherein the plurality of hooks extends from the back member with an upward bend proximate the back member, followed by a distal downward bend to form a front surface; and the front surface extends downward a distance greater than a thickness of the hook and the front surface is generally parallel to the back member.

Embodiments of the present invention also provide a method for displaying and organizing a plurality of phone cases comprising disposing a plurality of hooks on a back member surrounded by a frame; hanging each of the plurality of phone cases on respective ones of the plurality of hooks so that a back side of each of the plurality of phone cases are visible; and positioning a lip of each of the plurality of phone cases into a depression formed along a length of the plurality of hooks extending from the back member, wherein the plurality of hooks extends from the back member with an upward bend proximate the back member, followed by a distal downward bend to form a front surface; the front surface extends downward a distance greater than a thickness of the hook and the front surface is generally parallel to the back member; the plurality of hooks attaches to the back member along a back surface of each of the plurality of hooks; and the back surface is formed from terminating a top surface of the hook without any bends formed adjacent the back member.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
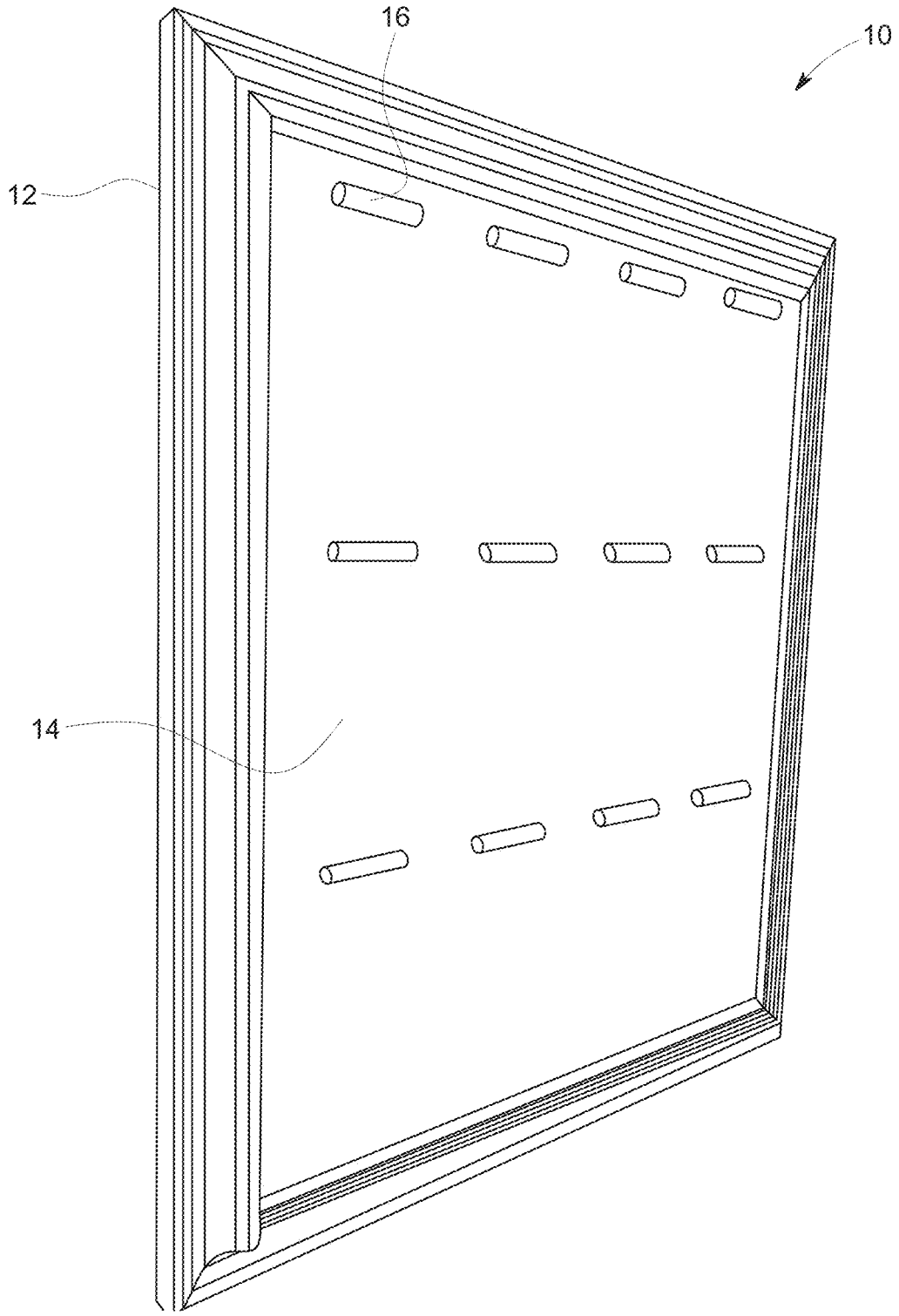
FIG. 1 illustrates a perspective view of a phone case display and organizer according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a phone case display and organizer that can display multiple mobile phone cases in such a way as to see the design on the back of the cases in a convenient and decorative way that organizes and protects them. The display case and organizer provide a solution for the clutter of multiple phone cases in a decorative and organized way such that the design is visible, and the individual cases are easily accessible for the customer to choose from and use.

Typically, phone cases can get damaged when stacked or crowded into small spaces. The display and organizer provide ample room to display the cases in a way that does not damage them while allowing the consumer to see the entire collection side by side in order to use them as fashion accessories. Having the cases displayed out in the open rather than stacked in a drawer allows the consumer to enjoy their collection and remember to use them regularly.

Figure 2:
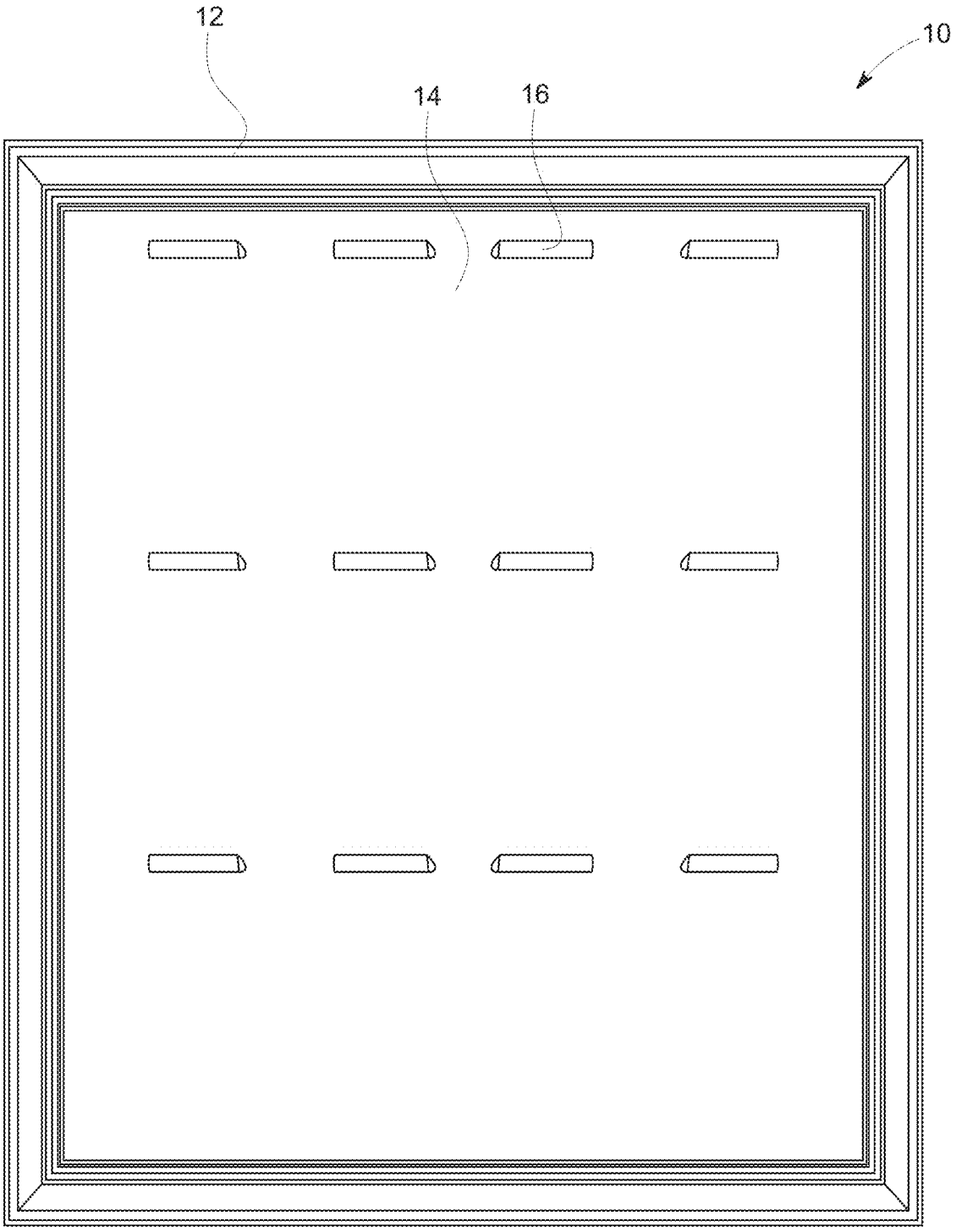
FIG. 2 illustrates a front view of a phone case display and organizer of FIG. 1.

Referring now to FIGS. 1 and 2, a phone case display and organizer 10 (also referred to as display 10, organizer 10, or display and organizer 10) can include an outer frame 12 that retains a back member 14 therewithin. The outer frame 12 can be similar to a picture frame, for example. While the Figures illustrate a rectangular frame, other shapes may be used within the scope of the present invention. The frame 12 may also be excluded from the organizer 10, provided that the back member 14 has sufficient rigidity to hold phone case, as described below.

A plurality of hooks 16 are attached to a front face of the back member 14. The hooks 16 can have various sizes and shapes. The hooks 16 have a length smaller than a width of a phone case to be hung on the hook 16. The hooks 16 may be equally spaced or may be unequally spaced so that the organizer 10 can hold cases of different sizes.

The back side of the back member 14 can include various hanging/displaying options as may be known in the art. For example, one or more eyes or saw-tooth bars may be disposed on the back side of the back member 14 or on the back side of the frame 12, for example. In some embodiments, a stand may be integrated into the back side of the back member 14, where the stand may be deployed to rest the organizer 10 on a surface, such as a dresser or nightstand, at an angle. Such stands are often employed by picture frames, for example.

Figure 5:
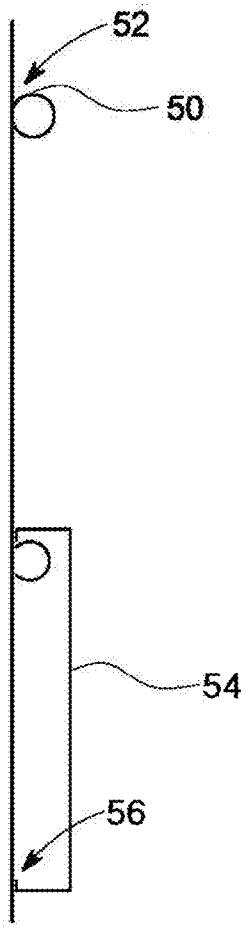
FIG. 5 illustrates a cross-sectional view taken along line V-V of FIG. 3.

As shown in FIG. 5, the hooks can have a round cross section, where a depression 52 is formed where the hook attaches to the back member. The depression 52 may be lower than a top 50 of the hook. A phone case 54 typically includes a lip 54 for retaining the phone case 54 on a phone. The lip 54 can fit into the depression 52 to prevent inadvertent removal of the phone case 54 from the organizer 10.

Figure 3:
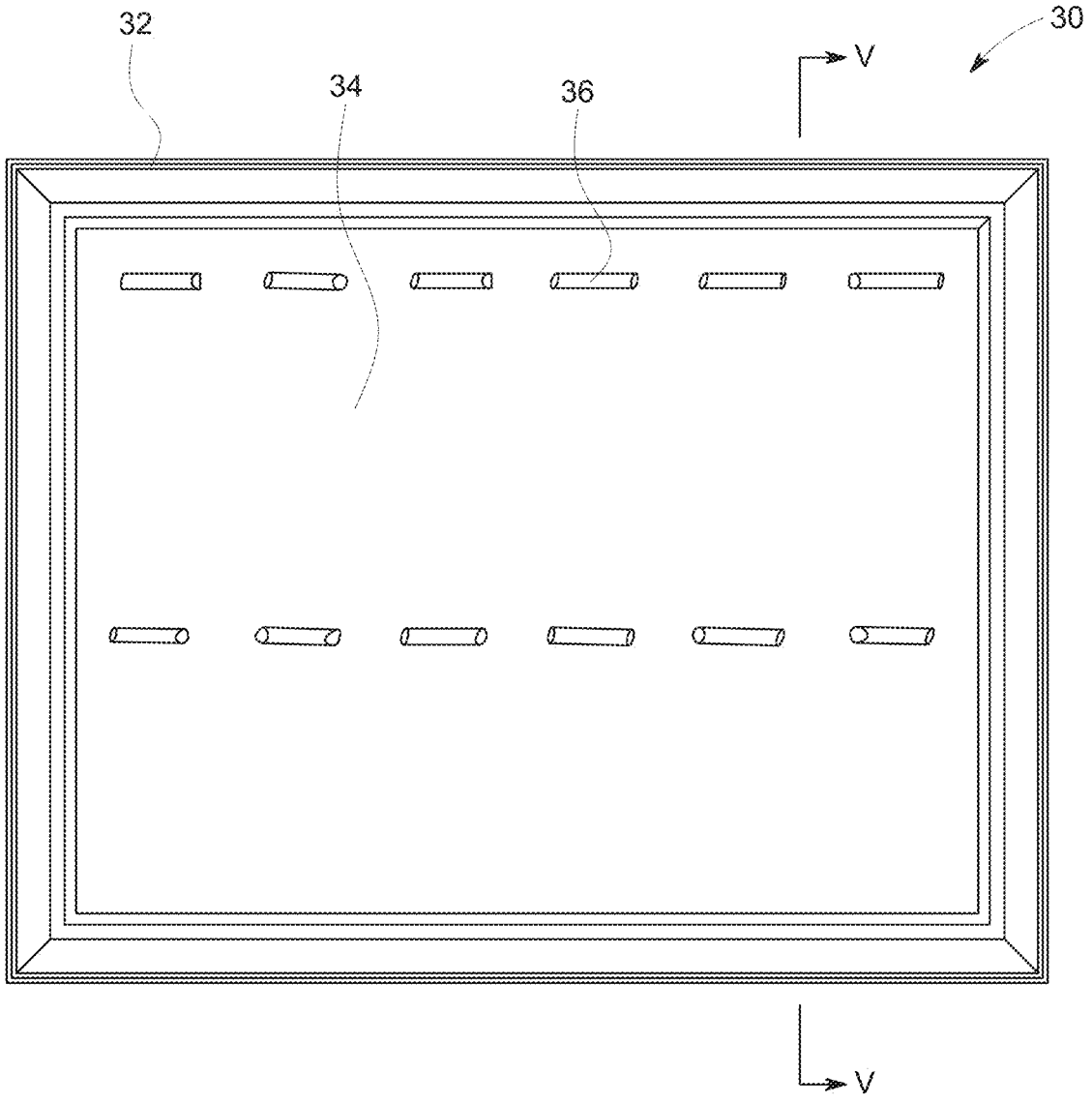
FIG. 3 illustrates an alternate arrangement of a phone case display and organizer according to an exemplary embodiment of the present invention.

Referring to FIG. 3, an organizer 30 can be formed in a landscape format. While FIGS. 1 and 3 provide two different arrangements for organizers 10, 30, it should be understood that other arrangements may be used within the scope of the present invention. The organizer 30 can include a frame 32, a back member 34 and a plurality of hooks 36, similar to that described above with respect to FIGS. 1 and 2.

Figure 4:
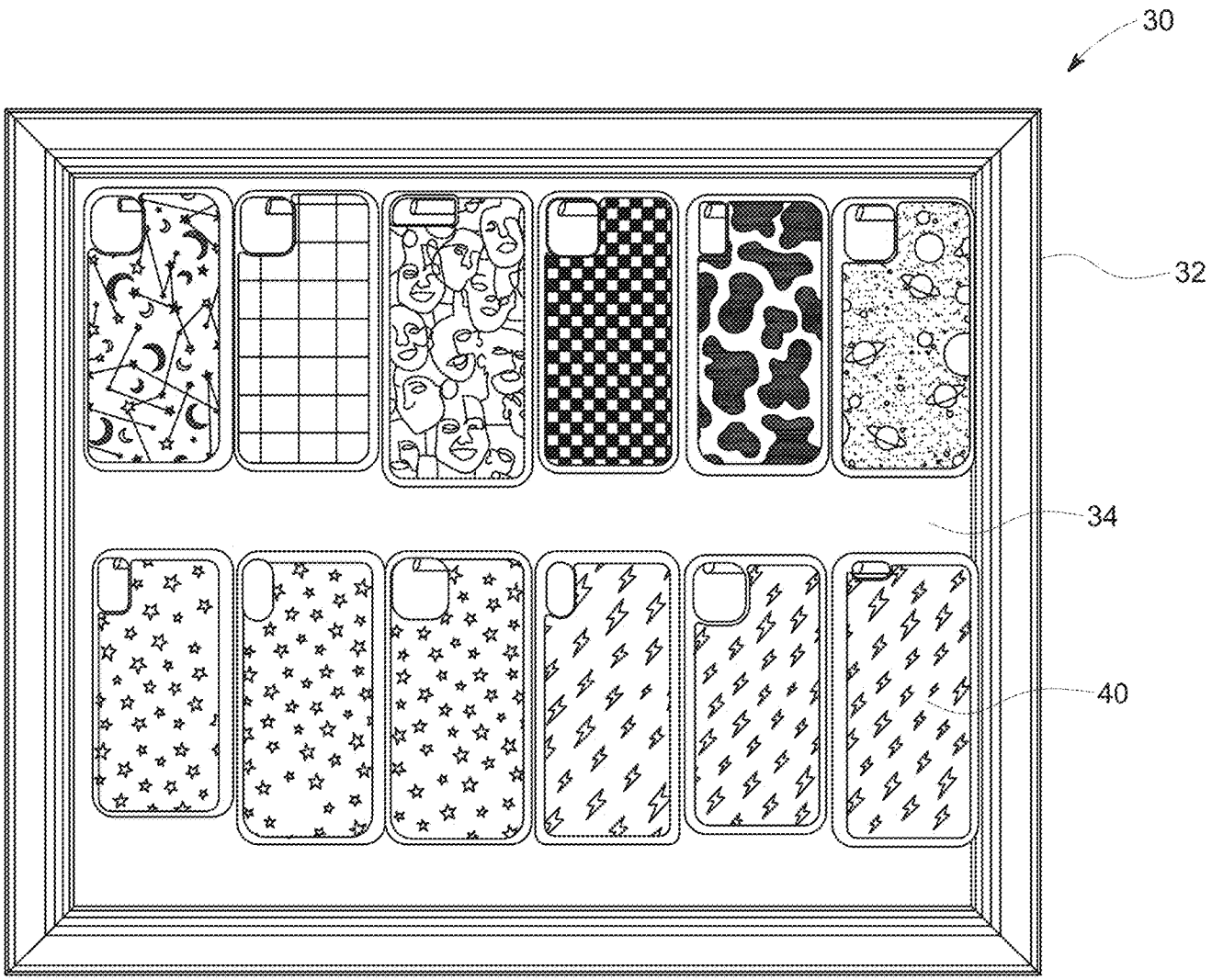
FIG. 4 illustrates a plurality of phone cases displayed on the phone case display and organizer of FIG. 3.

FIG. 4 shows the organizer 30 of FIG. 3 having a plurality of phone cases 40 displayed thereupon. As can be seen, a user can readily see the back sides of the phone cases 40 and can easily choose a phone case based on the user's mood, outfit, or the like.

While the Figures show the phone cases hanging vertically, the organizer may be designed to hold phone cases horizontally as well. Further, while a single hook is illustrated for each phone case, in some embodiments, two hooks may be used to retain each of the phone cases on the organizer.

While the Figures show the organizer assembled, in some embodiments, a kit can be provided that includes the back member, optional frame, a plurality of hooks, and a mounting mechanism for attaching the hooks on the back member. The mounting mechanism can include glue, epoxy, a hook and slot design, hook and loop fastener, or the like. In some embodiments, the hooks may include one or more magnets (or be formed from a magnetic material) and the back member may be formed of a magnetically attractive material. This design can permit the user to attach the hooks on the back member at a desired spacing based on the cases they own, including cases for phones, tablets, and the like.

While the size and shape of the organizer can vary, typically the organizer can be sized to hold at least 8 or more, often at least 12 or more, phone cases. While multiple rows and columns are shown, various configurations may be used, including single rows or columns, offset rows or columns or the like. While the figures show a single case on each hook, in some embodiments, multiple cases may be stacked on one hook, such as a smaller case nested inside a larger case, for example. Typically, a plurality of hooks may be provided, such as at least 4 hooks, at least 6 hooks, or even at least 8 hooks, however, the organizer may be designed to hold anywhere from two or more phone cases.

Figure 6:
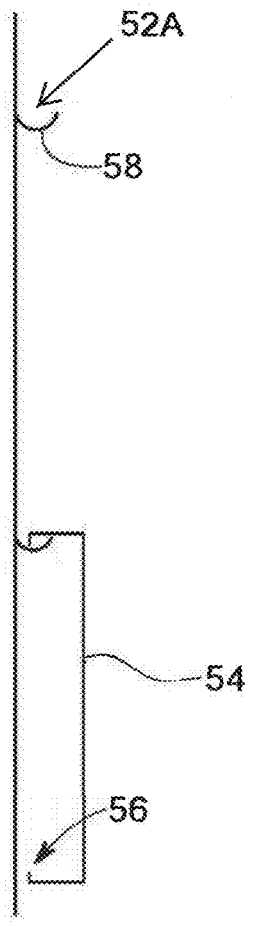
FIG. 6 illustrates another exemplary hook configuration for a phone case display and organizer according to an exemplary embodiment of the present invention.
Figure 7:
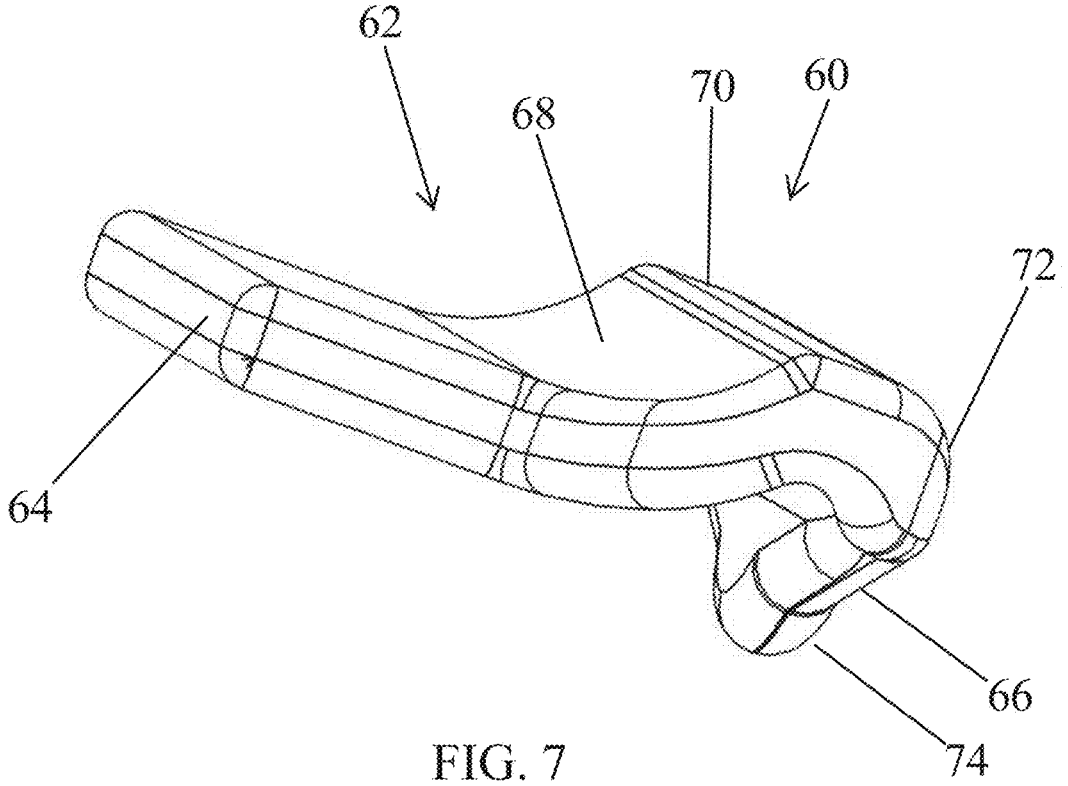
FIG. 7 illustrates a perspective view of an embodiment of a hook member according to an exemplary embodiment of the present invention.
Figure 8:
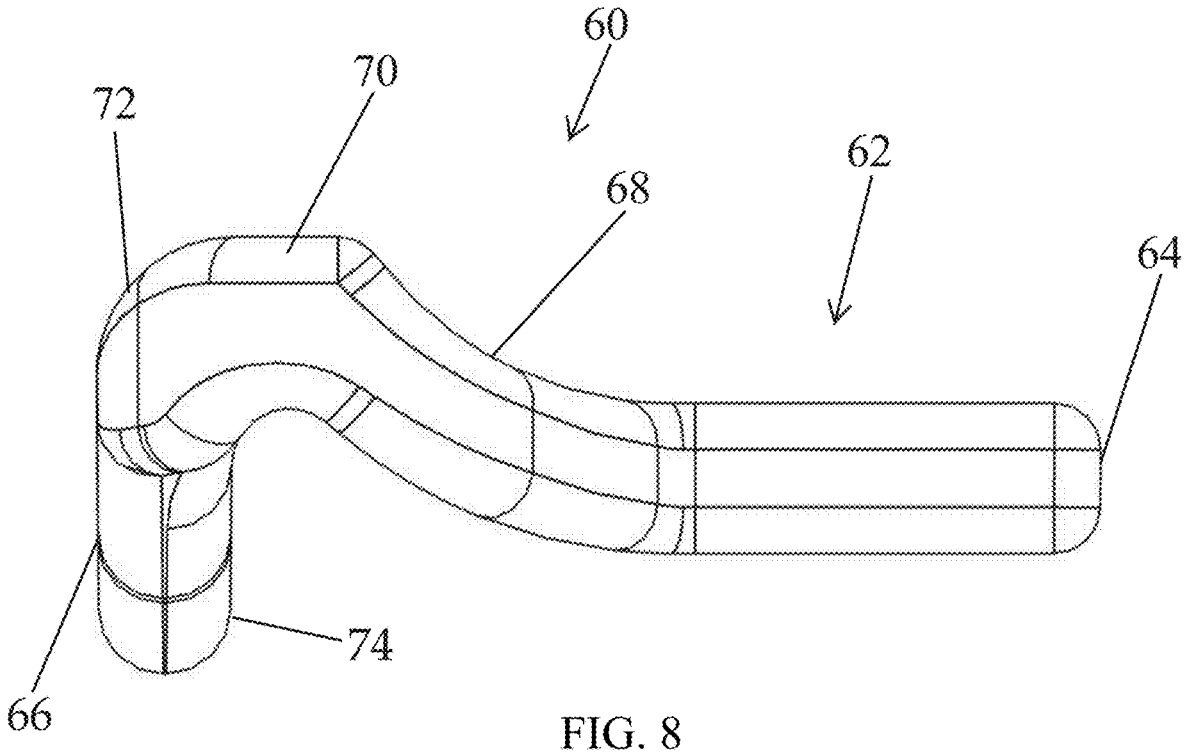
FIG. 8 illustrates a side view of the hook member of FIG. 7.
Figure 9:
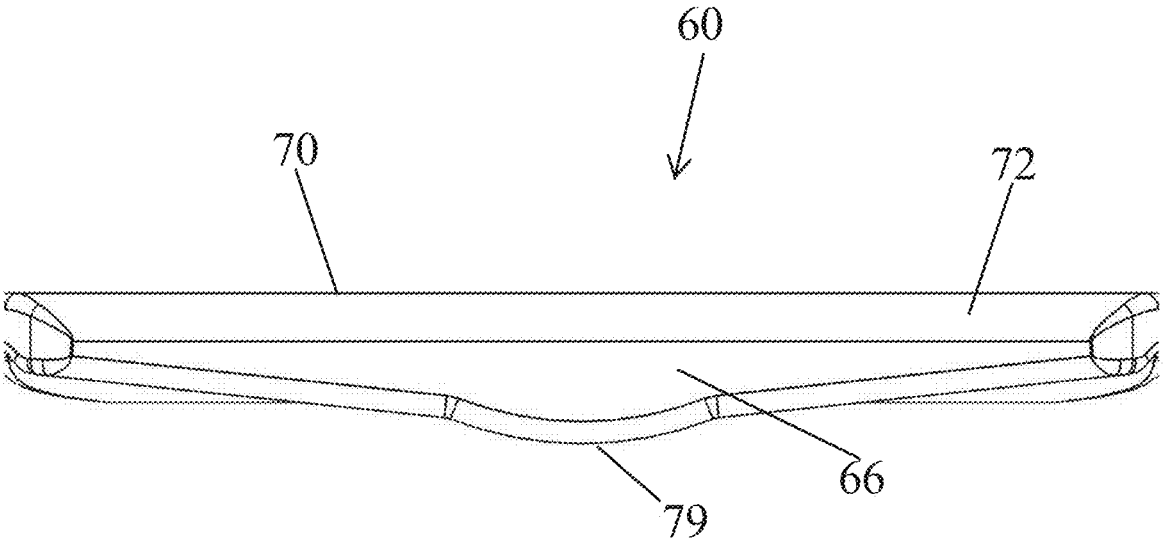
FIG. 9 illustrates a front view of the hook member of FIG. 7.
Figure 10:
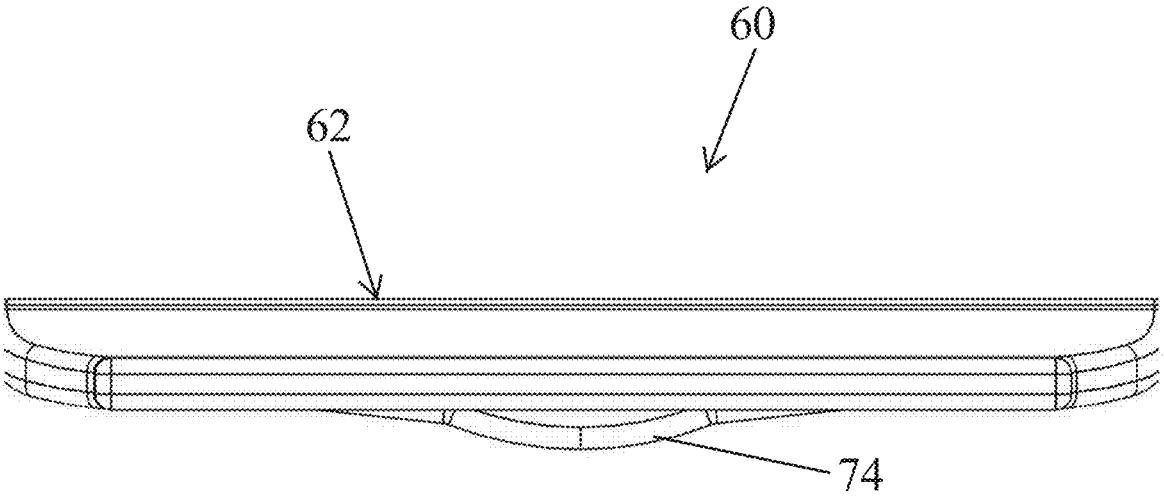
FIG. 10 illustrates a back view of the hook member of FIG. 7.
Figure 11:
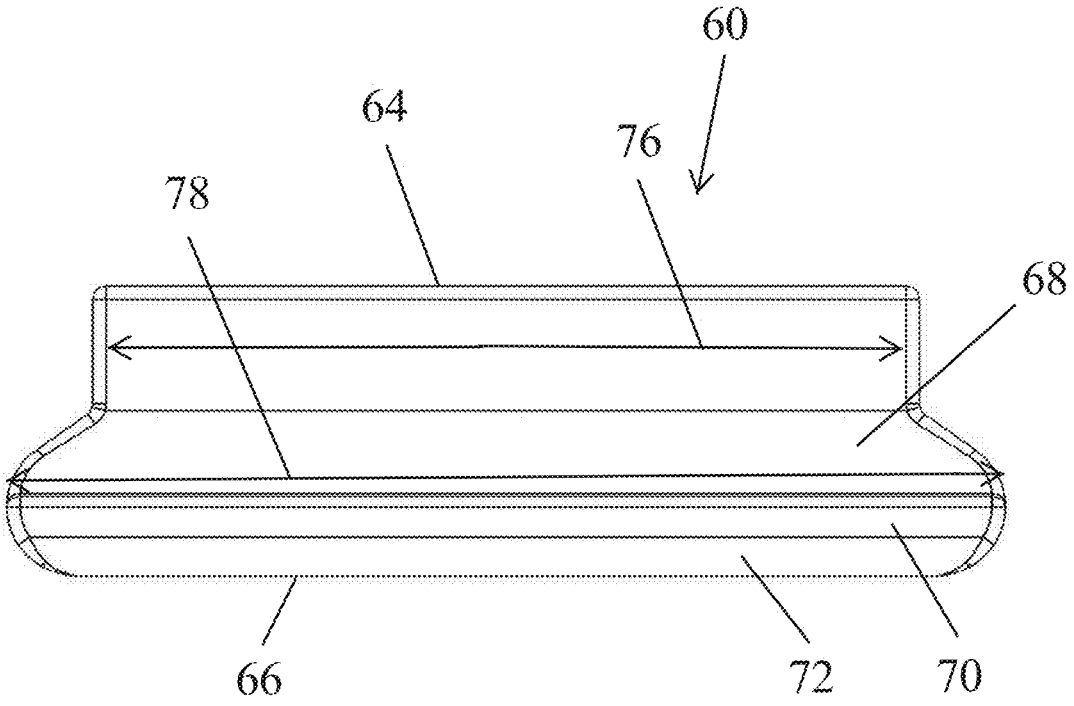
FIG. 11 illustrates a top view of the hook member of FIG. 7.
Figure 12:
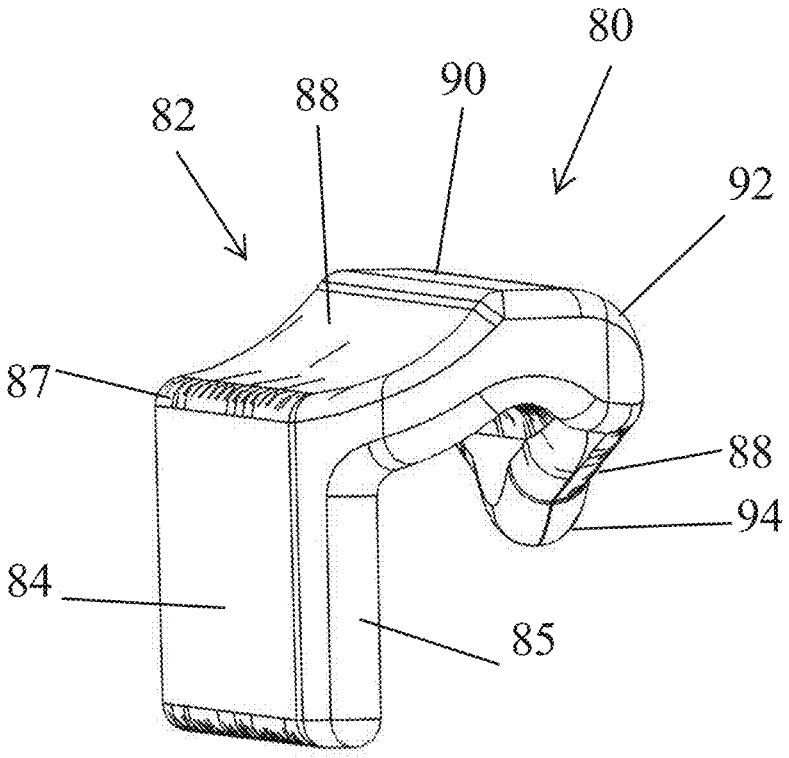
FIG. 12 illustrates a perspective view of an embodiment of a hook member according to an exemplary embodiment of the present invention.
Figure 13:
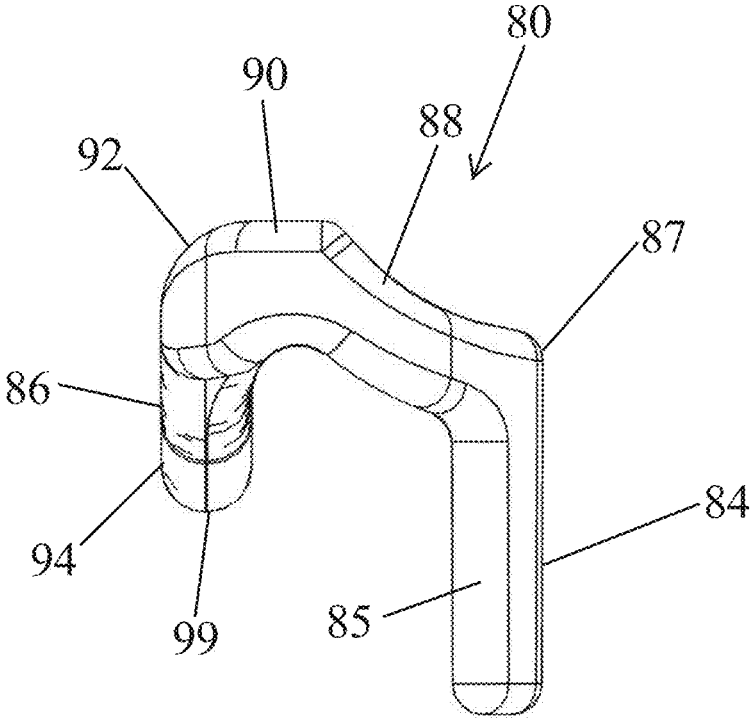
FIG. 13 illustrates a side view of the hook member of FIG. 12.
Figure 14:
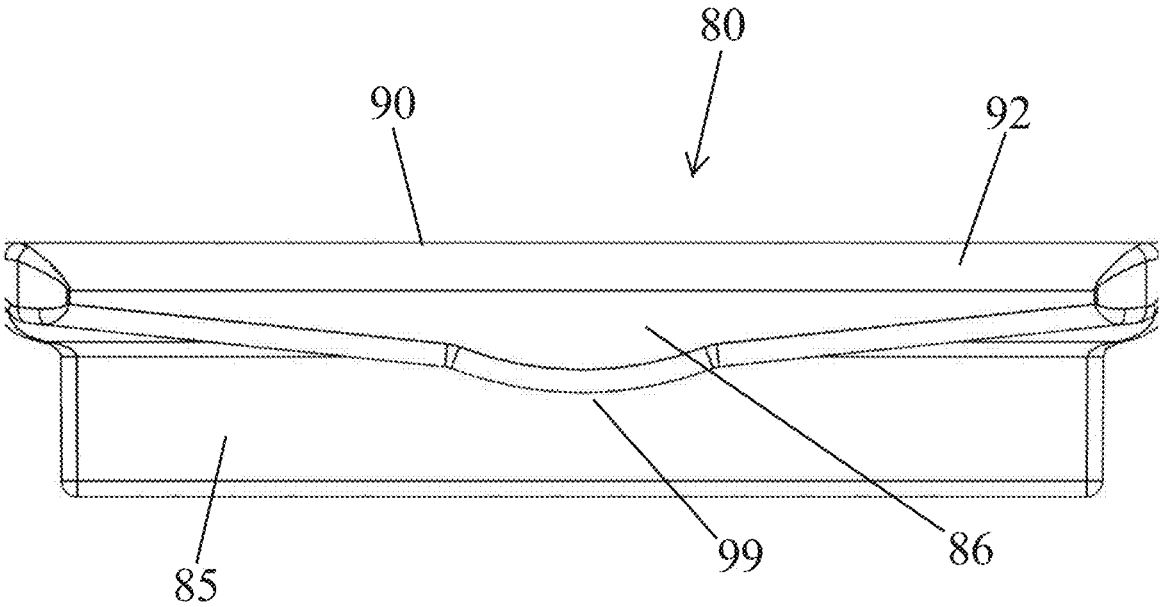
FIG. 14 illustrates a front view of the hook member of FIG. 12.
Figure 15:
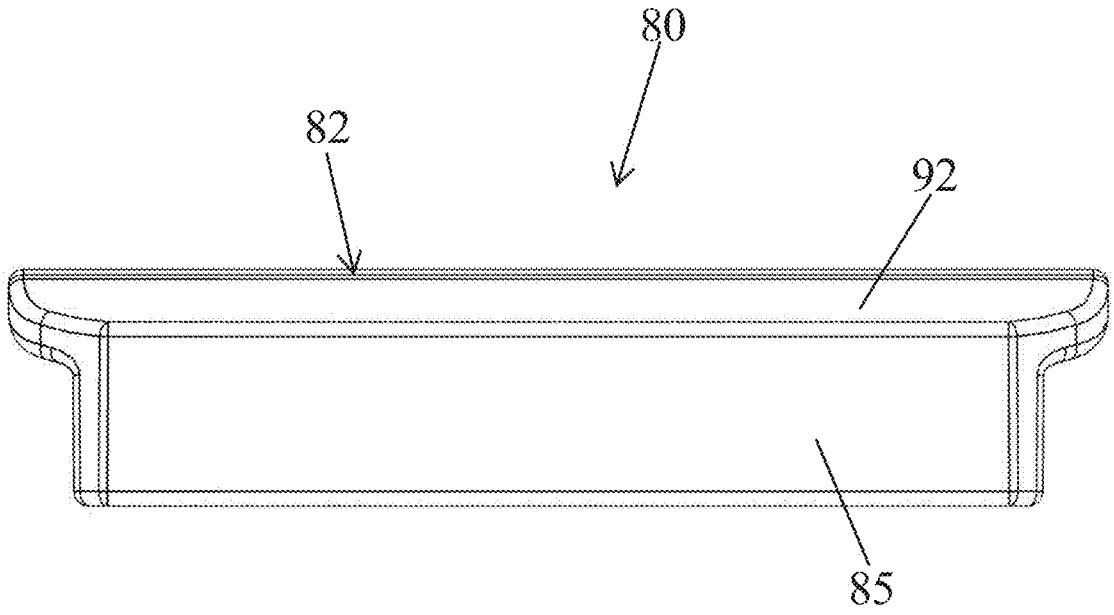
FIG. 15 illustrates a back view of the hook member of FIG. 12.
Figure 16:
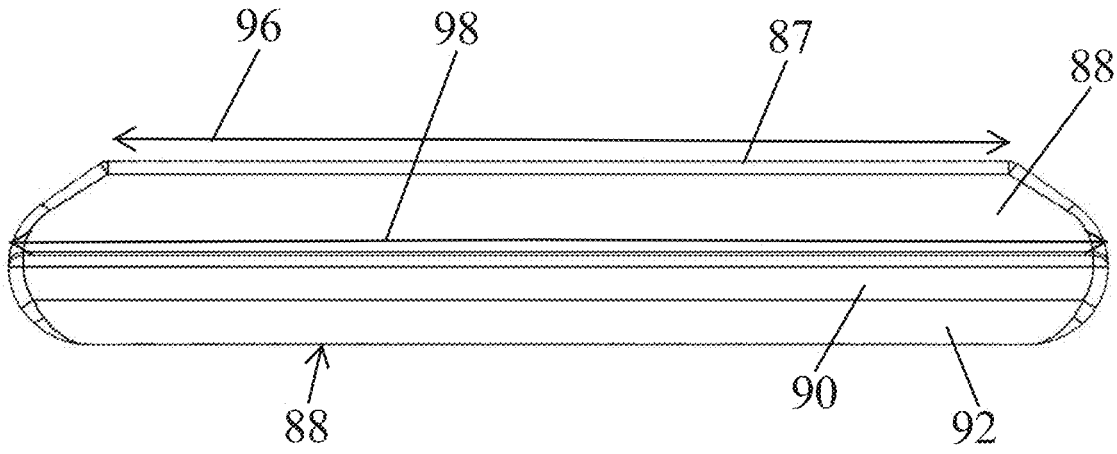
FIG. 16 illustrates a top view of the hook member of FIG. 12.
Figure 17:
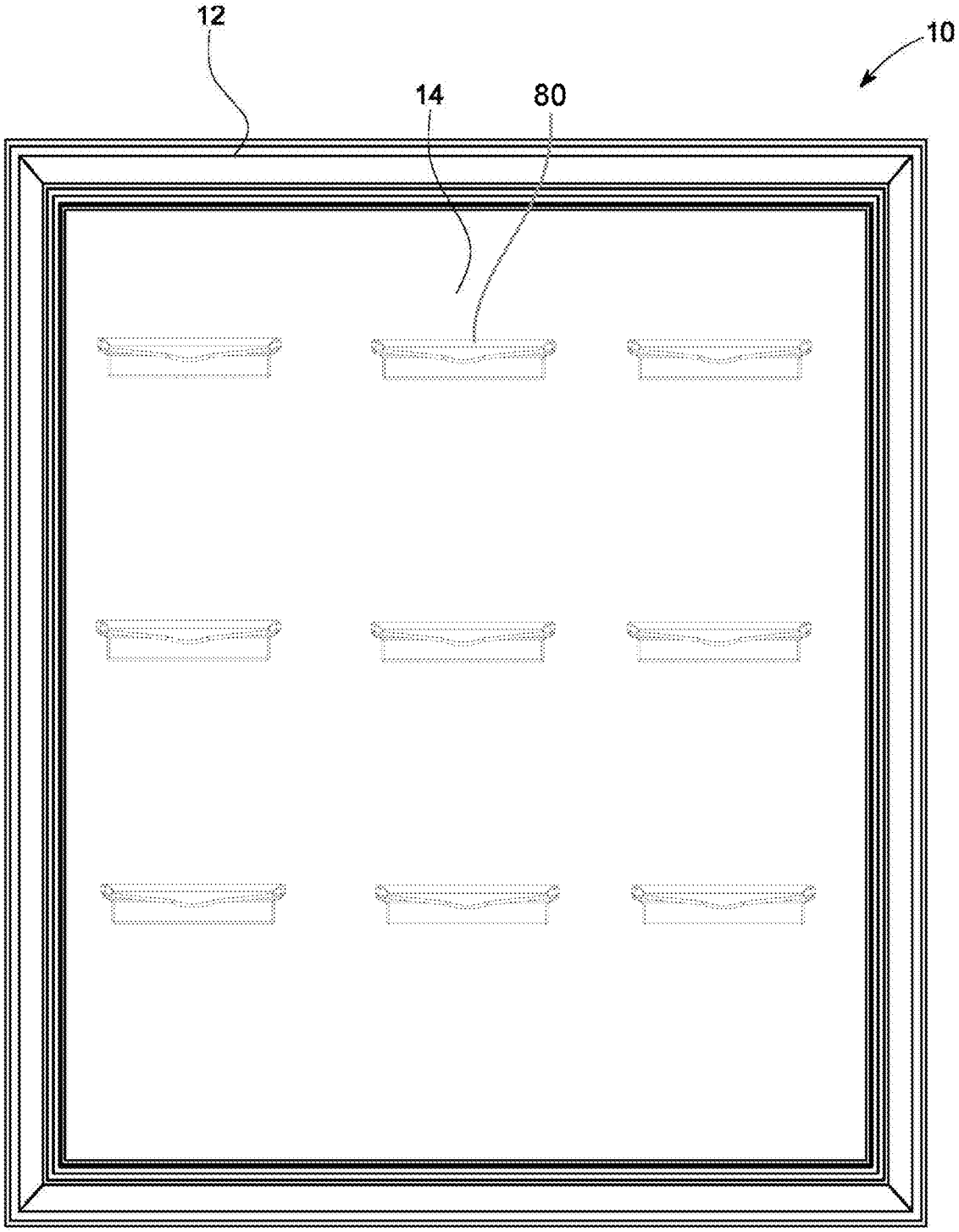
FIG. 17 illustrates a front view of the hook member of FIG. 12 on the phone case display, according to an exemplary embodiment of the present invention.
Figure 18:
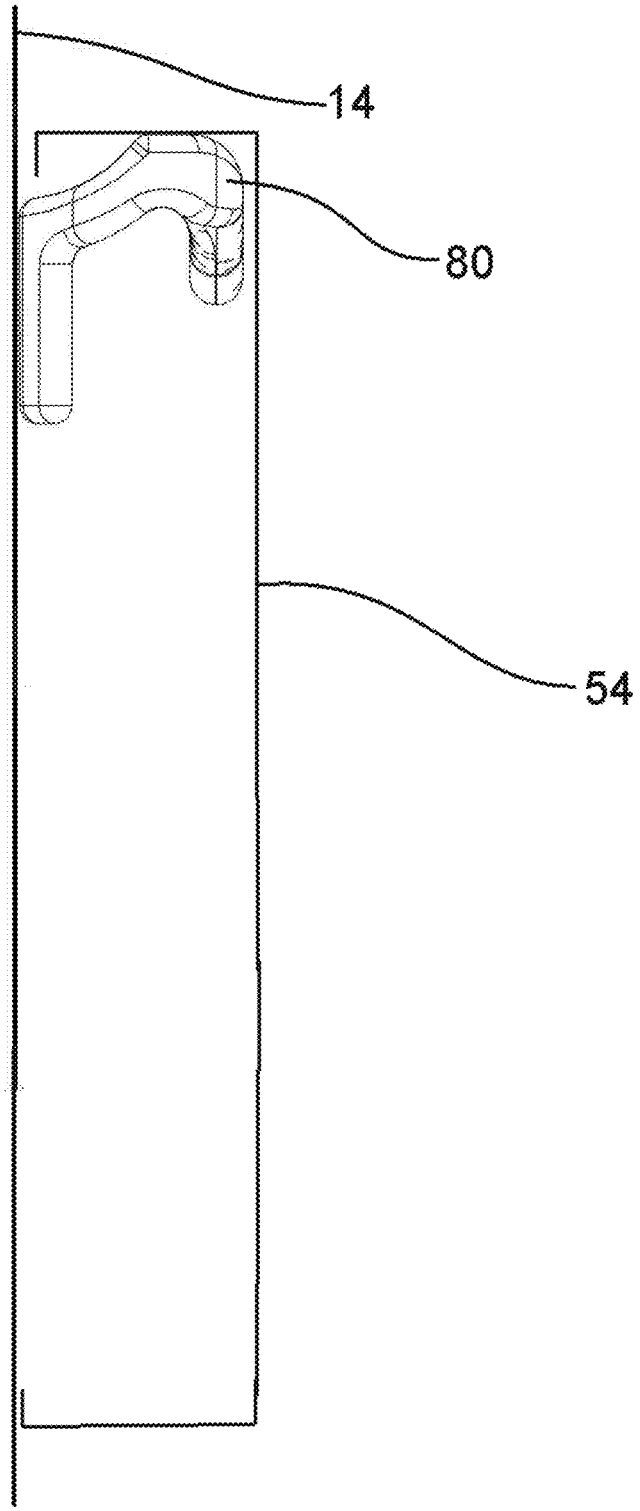
FIG. 18 illustrates a side view of a portion of a backer board having the hook member of FIG. 12, with a phone case disposed on the hook member.
Figure 19:
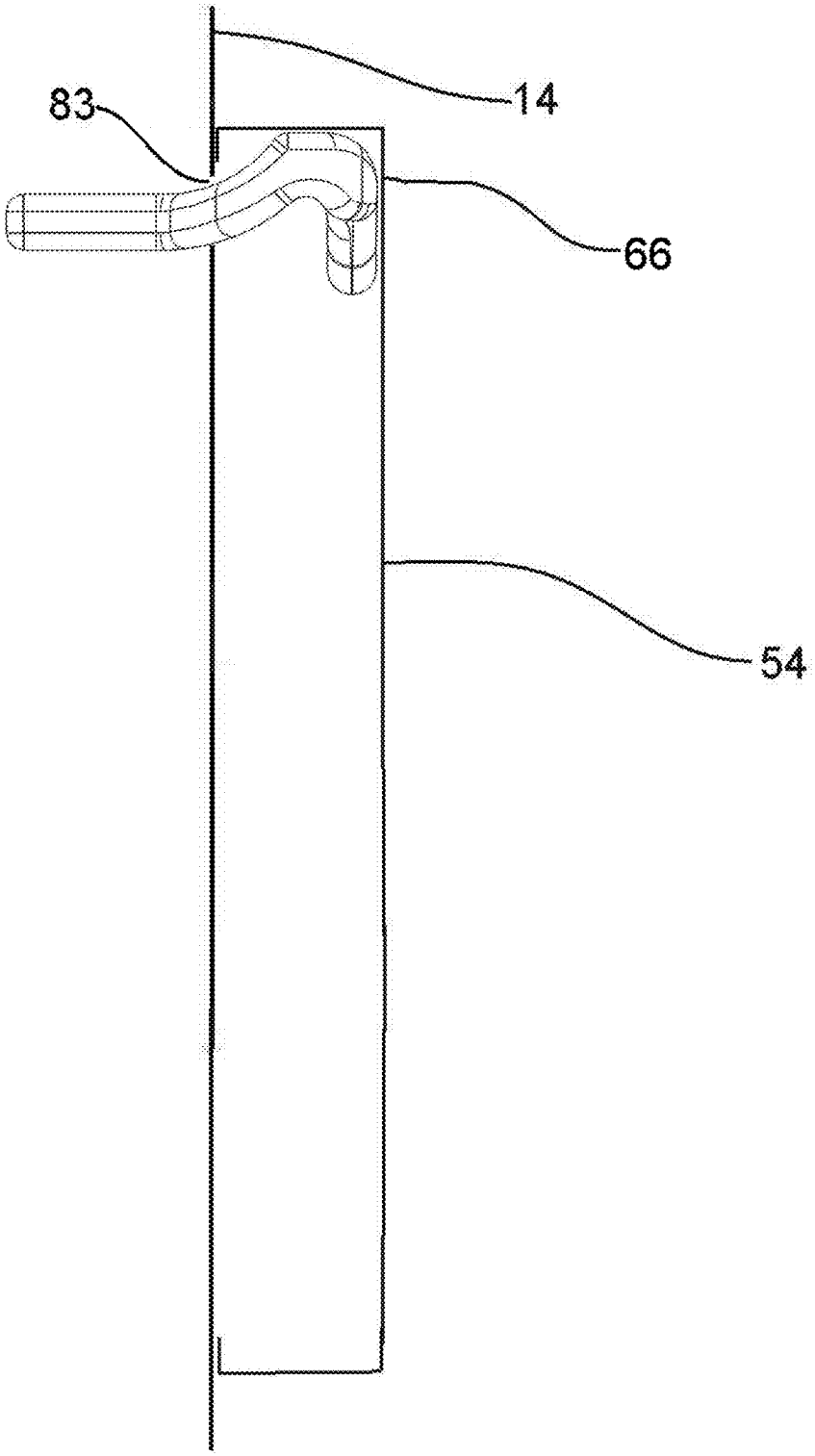
FIG. 19 illustrates a side view of a portion of a backer board having the hook member of FIG. 8 disposed within a slot formed in the backer board, according to an exemplary embodiment of the present invention.

In some embodiments, as shown in FIG. 6, a hook 58 can be designed as a hollow arc, where the lip 56 of the phone case 54 can fit behind the raised distal end of the arc. While FIG. 6 shows a rounded arc shape, the shape could be hook shaped, where the distal end of the arc curves around to point toward the back member of the organizer. The hook 58 can cause the inside edge of the phone case to be disposed closer to the hook such that the hook is not visible through the camera/light opening of the phone case.

Referring now to FIGS. 7 through 11, the hooks 16 described above for the organizer 10 may be designed as a hook member 60 that can include an upper surface 62 configured to support a portion of a phone case 40 (see FIG. 4). The upper surface 62 can curve upward along a bend 68 to reach an uppermost portion 70 of the hook member 60. From the uppermost portion 70, a bend 72 may angle the hook member 60 downward along downward projecting portion 66 to end at a narrowed front bottom portion 74.

The hook member 60 may attach to the back member 14 of the organizer 10 (see FIG. 2, for example) along a back surface 64 of the hook member 60. In some embodiments, the back surface 64 may be permanently affixed to the back member 14, either directly to the back member 14, or in a slot 83 formed in the back member. In other embodiments, a slot 83 may be formed in the back member 14 to permit the hook members 60 to be removably engaged into the back member 14 as desired locations. In the latter embodiment, any slots not used may be filled by a blank, configured to hide unused slots in the back member 14.

The upward bend 68 can prevent the phone cases from slipping off the hook member 60, which the downward projecting portion 66 may help support the phone case by contacting an inner surface of the phone case when the phone case is disposed on the hook member 60.

As shown in the FIGS. 7 through 11, the hook member 60 can have a first length 76 of the back end 64 thereof. The length can widen through the upward bend 68 to a maximum length 78 at the uppermost portion 70. The length can narrow through the downward bend 72 to form the downward projecting portion 66, which further narrows to curved point 79 at the front bottom portion 74.

The maximum length 78 may be sufficient to support the phone case without the phone case tipping. This length 78 may be from about 20% to about 90%, typically over 50% of the overall width of the phone case. In some embodiments, the hook member 60 may not be visible through a photo lens opening in the phone case. While, in some embodiments, the hook member 60 may extend above the photo lens opening of the phone case, due to the bends and shape of the hook member 60, the hook member 60 may not be visible from a front view of the organizer 10, thus the phone cases may appear to be floating on the back member 14 of the organizer.

Referring to FIGS. 12 through 16, a hook member 80 may be formed similar to the hook member 60, however, its top may bend downward to provide an increased surface area for attachment of the hook member 80 to the back member 14 of the organizer 14.

More specifically, the hooks 16 described above for the organizer 10 may be designed as a hook member 80 that can include an upper surface 82 configured to support a portion of a phone case 40 (see FIG. 4). The upper surface 82 can curve upward along a bend 88 to reach an uppermost portion 90 of the hook member 80. From the uppermost portion 90, a bend 92 may angle the hook member 80 downward along downward projecting portion 86 to end at a narrowed front bottom portion 94.

The hook member 80 may attach to the back member 14 of the organizer 10 (see FIG. 2, for example) along a back surface 84 of the hook member 80. The back surface 84 may be formed as an extension 85 that extends downward at a rear end 87 of the upper surface 82 of the hook member 80.

In some embodiments, the back surface 84 may be permanently affixed to the back member 14, either directly to the back member 14, or in a slot formed in the back member. In other embodiments, a slot (not shown) may be formed in the back member 14 to permit the hook members 80 to be removably engaged into the back member 14 as desired locations. In some embodiments, the extension 80 may insert into the slots and be hidden behind the back member 14. In the latter embodiment, any slots not used may be filled by a blank, configured to hide unused slots in the back member 14.

The upward bend 88 can prevent the phone cases from slipping off the hook member 80, which the downward projecting portion 86 may help support the phone case by contacting an inner surface of the phone case when the phone case is disposed on the hook member 80.

As shown in the FIGS. 12 through 16, the hook member 80 can have a first length 96 of the back end 84 thereof. The length can widen through the upward bend 88 to a maximum length 98 at the uppermost portion 90. The length can narrow through the downward bend 92 to form the downward projecting portion 86, which further narrows to curved point 99 at the front bottom portion 94.

The maximum length 98 may be sufficient to support the phone case without the phone case tipping. This length 98 may be from about 20% to about 90%, typically over 50% of the overall width of the phone case. In some embodiments, the hook member 80 may not be visible through a photo lens opening in the phone case. While, in some embodiments, the hook member 80 may extend above the photo lens opening of the phone case, due to the bends and shape of the hook member 80, the hook member 80 may not be visible from a front view of the organizer 10, thus the phone cases may appear to be floating on the back member 14 of the organizer.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A method for displaying and organizing a plurality of phone cases, comprising:

disposing a plurality of hooks on a back member; and hanging each of the plurality of phone cases on respective ones of the plurality of hooks so that a back side of each of the plurality of phone cases are visible, wherein the plurality of hooks extends from the back member with an upward bend proximate the back member, followed by a distal downward bend to form a front surface; and the plurality of hooks attaches to the back member along a back surface of each of the plurality of hooks;

each of the plurality of hooks have a length that varies along a body of the hook as it extends from the back member;

the back surface has a first length;

the upward bend creating a second increasing length along the upward bend to form a maximum length at a top surface of the hook; and the hook having a decreasing length through the downward bend and downward along the front surface.

2. The method of claim 1, wherein the front surface extends downward a distance greater than a thickness of the hook and the front surface is generally parallel to the back member.

3. The method of claim 1, further comprising surrounding the back member by a frame.

4. The method of claim 1, further comprising disposing a lip of each of the plurality of phone cases into a depression formed along a length of the plurality of hooks extending from the back member.

5. The method of claim 1, wherein at least 8 hooks are disposed on the back member for displaying at least 8 phone cases thereupon.

6. The method of claim 1, wherein the hooks are equally spaced apart in two or more rows on the back member.

7. The method of claim 1, further comprising assembling the hooks on the back member at a desired spacing to permit each hook to support a respective phone case.

8. The method of claim 1, wherein the back surface is formed from terminating a top surface of the hook without any bends formed adjacent the back member.

9. The method of claim 1, wherein each of the plurality of hooks are invisible from a front view when the phone cases are hung on the plurality of hooks.

10. The method of claim 1, wherein the back surface is formed from a downward bend at a rear of a top surface of the hook.

11. A method for displaying and organizing a plurality of phone cases, comprising:

disposing a plurality of hooks on a back member surrounded by a frame;

hanging each of the plurality of phone cases on respective ones of the plurality of hooks so that a back side of each of the plurality of phone cases are visible; and positioning a lip of each of the plurality of phone cases into a depression formed along a length of the plurality of hooks extending from the back member, wherein the plurality of hooks extends from the back member with an upward bend proximate the back member, followed by a distal downward bend to form a front surface;

the front surface extends downward a distance greater than a thickness of the hook and the front surface is generally parallel to the back member; and the plurality of hooks each include a back arm disposed adjacent the back member, a top member that connects to the back arm with the upward bend, and a front member that extends downward from the top member, the front member is spaced apart from the back arm.

12. The method of claim 11, wherein:

each of the plurality of hooks have a length that varies along a body of the hook as it extends from the back member;

the back surface has a first length;

the upward bend creating a second increasing length along the upward bend to form a maximum length at a top surface of the hook; and the hook having a decreasing length through the downward bend and downward along the front surface.

13. The method of claim 11, wherein the back surface is formed from terminating a top surface of the hook without any bends formed adjacent the back member.

14. The method of claim 11, wherein each of the plurality of hooks are invisible from a front view when the phone cases are hung on the plurality of hooks.

15. The method of claim 11, wherein the back surface is formed from a downward bend at a rear of a top surface of the hook.

16. A method for displaying and organizing a plurality of phone cases, comprising:

disposing a plurality of hooks on a back member surrounded by a frame;

hanging each of the plurality of phone cases on respective ones of the plurality of hooks so that a back side of each of the plurality of phone cases are visible; and positioning a lip of each of the plurality of phone cases into a depression formed along a length of the plurality of hooks extending from the back member, wherein the plurality of hooks extends from the back member with an upward bend proximate the back member, followed by a distal downward bend to form a front surface;

the front surface extends downward a distance greater than a thickness of the hook and the front surface is generally parallel to the back member;

the plurality of hooks attaches to the back member along a back surface of each of the plurality of hooks; and the back surface is formed from terminating a top surface of the hook without any bends formed adjacent the back member; and the plurality of hooks each include a back arm disposed adjacent the back member, a top member that connects to the back arm with the upward bend, and a front member that extends downward from the top member, the top member having a width greater than the back arm and the front member.

17. The method of claim 16, wherein each of the plurality of hooks are invisible from a front view when the phone cases are hung on the plurality of hooks.

18. The phone case display and organizer of claim 16, wherein at least 8 hooks are disposed on the back member for displaying at least 8 phone cases thereupon.

19. The phone case display and organizer of claim 16, wherein the hooks are equally spaced apart in two or more rows on the back member.

* * * * *